US010145139B2

(12) United States Patent
Tufto et al.

(10) Patent No.: US 10,145,139 B2
(45) Date of Patent: Dec. 4, 2018

(54) INSULATING FABRIC FOR OUTDOOR ACTIVITY SHELTERS

(71) Applicant: Innovative Outdoor Solutions, Inc., Maple Lake, MN (US)

(72) Inventors: Troy Tufto, Maple Lake, MN (US); Chris Witte, Maple Lake, MN (US)

(73) Assignee: Innovative Outdoor Solutions, Inc., Maple Lake, MN (US)

( * ) Notice: Subject to any disclaimer, the term of this patent is extended or adjusted under 35 U.S.C. 154(b) by 0 days.

(21) Appl. No.: 15/043,942

(22) Filed: Feb. 15, 2016

(65) Prior Publication Data

US 2016/0237714 A1 Aug. 18, 2016

Related U.S. Application Data

(60) Provisional application No. 62/116,020, filed on Feb. 13, 2015, provisional application No. 62/119,649, filed on Feb. 23, 2015.

(51) Int. Cl.

| | |
|---|---|
| ***E04H 15/54*** | (2006.01) |
| ***E04H 15/00*** | (2006.01) |
| ***E04H 15/64*** | (2006.01) |
| ***E04H 1/12*** | (2006.01) |
| *E04H 15/20* | (2006.01) |

(52) U.S. Cl.

CPC ..... *E04H 15/001* (2013.01); *E04H 1/1205* (2013.01); *E04H 15/54* (2013.01); *E04H 15/64* (2013.01); *E04H 2015/207* (2013.01)

(58) Field of Classification Search

CPC ..... E04H 15/54; E04H 15/36; E04H 15/64; E04H 15/001; E04H 2015/207; E04H 15/44; Y10T 428/24033

USPC ..... 135/124, 137, 115–116, 119; 52/63, 83, 52/222, 223.6; 428/102–104

See application file for complete search history.

(56) References Cited

U.S. PATENT DOCUMENTS 2,299,078 A * 10/1942 Craig ..... E04H 15/54 135/115
4,024,679 A * 5/1977 Rain ..... E04H 15/20 359/890
4,391,865 A * 7/1983 Constance ..... A47H 21/00 160/330
4,700,514 A * 10/1987 Reineman ..... E04B 1/3205 52/80.1
4,878,322 A * 11/1989 Ikeda ..... A01G 9/1415 52/2.18
4,956,218 A * 9/1990 Haining ..... A62C 8/06 169/50
5,571,592 A * 11/1996 McGregor ..... B32B 5/26 428/313.3
5,792,542 A * 8/1998 Morgon ..... A41D 31/00 428/102
7,882,849 B2 * 2/2011 Franta ..... E04H 15/001 135/115

(Continued)

*Primary Examiner* — Winnie Yip
(74) *Attorney, Agent, or Firm* — Dicke, Billig & Czaja, PLLC

(57) ABSTRACT

Embodiments include an outdoor activity structure, comprising: a wall that defines an interior room of the structure, the wall comprises an insulating layer disposed between an inner layer and an outer layer wherein the inner layer is coupled with the insulating layer by a plurality of inner seams and the outer layer is coupled to the insulating layer by a perimeter seam.

18 Claims, 6 Drawing Sheets

(56) References Cited

U.S. PATENT DOCUMENTS

| | | | | |
|---|---|---|---|---|
| 9,371,665 | B2 * | 6/2016 | Herpin | E04H 15/40 |
| 9,512,632 | B2 * | 12/2016 | Cook | E04H 15/54 |
| 2010/0225488 | A1 * | 9/2010 | Hinterlong | G08B 21/0461 340/573.4 |
| 2011/0250331 | A1 * | 10/2011 | Murray et al. | A47J 39/02 428/74 |
| 2012/0090455 | A1 * | 4/2012 | Duncan | E04H 9/10 89/36.07 |

* cited by examiner

INSULATING FABRIC FOR OUTDOOR ACTIVITY SHELTERS

This application claims the benefit of U.S. Provisional Application No. 62/116,020, filed Feb. 13, 2015 and U.S. Provisional Application No. 62/119,649, filed Feb. 23, 2015, the contents of which are herein incorporated by reference.

FIELD OF THE TECHNOLOGY

The present application relates to ice fishing shelters and hunting shelters, also referred to as outdoor activity structures, and to fabric walls for such shelters. More specifically, the present application relates to an insulating fabric assembly for such outdoor activity structures.

BACKGROUND

Insulated shelters, such as ice fishing shelters and hunting blinds (or the like) currently on the market can include multiple layers of fabric. Seams attach all of the layers together. These welded or sewn seams transfer through all of the layers thereby maximizing the through seams, compressing the insulation and reducing the thermal properties of the fabric. In some shelters the seams can also allow light to pass through the wall of the shelters. In addition, ice and frost can form on the through seams because those areas do not provide adequate insulation from the exterior.

Accordingly, there is a need for an improved system of seams to increase insulation and decrease light permeability.

SUMMARY

The present invention is directed, in part, to an outdoor activity structure. The outer walls of the activity structure are formed of fabric, typically a multiple layer construction with at least three layers: An inner layer, an outer layer, and an intermediate insulating layer. The inner layer and intermediate layer are joined together at numerous points, typically in a quilted type construction. However, the outer layer is joined to the inner and intermediate layers much less, generally along only the perimeter of the walls of the outdoor recreational shelter. The result is an outer wall that can optionally be free-floating relative to the inner layers, thereby forming an air pocket to provide further insulation. In addition, the significant reduction in seams or stitches that go all the way through the fabric walls provides improved overall insulation, and also provides better prevention of light penetration, allowing for a darker structure (useful for spear fishing). This design also reduces "cold" spots along the wall that otherwise can occur with frequent stitching through the wall, which thus avoids condensation or frost from forming at those cold spots.

Embodiments disclosed herein include an outdoor activity structure, comprising a wall that defines an interior room of the structure, the wall comprises an insulating layer disposed between an inner layer and an outer layer; the inner layer is configured to be within the outdoor activity structure and the outer layer is configured to define at least a portion of the boundary of the outdoor activity structure; wherein the inner layer is coupled with the insulating layer by a plurality of inner seams; wherein the inner layer, the insulating layer and the inner seams define a plurality of inner cavities; wherein the outer layer is coupled to the insulating layer by a perimeter seam; wherein the outer layer, the insulating layer and the perimeter seam define an outer cavity; wherein the outer cavity has a volume of at least 5 times the volume of any of the inner cavities.

In an embodiment, the inner seams define a plurality of quadrilaterals on the inner layer.

In an embodiment, the quadrilaterals are squares.

In an embodiment, each side of the quadrilaterals has a length of at least one inch and not more than 5 inches.

In an embodiment, the inner seams and the perimeter seams are sonically welded seams.

In an embodiment, the inner seams and the perimeter seams are stitched seams.

In an embodiment, the inner layer comprises nylon.

In an embodiment, the inner layer is wind resistant. In an embodiment the outer layer is wind resistant.

In an embodiment, the perimeter seam couples the inner layer, the insulating layer, and the outer layer together.

In an embodiment, the wall has a thickness of at least 0.05 inches and not more than 0.5 inches.

In an embodiment, the wall is opaque.

In an embodiment, the outdoor activity structure can further include a floor structure, wherein the wall is coupled to the floor structure.

In an embodiment, the floor structure defines at least one hole.

In an embodiment, the wall is coupled to the floor structure around at least a portion of the perimeter of the floor structure.

In an embodiment, the plurality of inner seams includes a plurality of first seams and a plurality of second seams; wherein each of the seams in the plurality of first seams are parallel with each other; wherein each of the seams in the plurality of second seams are parallel with each other; and wherein the plurality of first seams are perpendicular to the plurality of second seams.

In an embodiment, the wall is flexible.

In an embodiment, an outdoor activity structure comprises: a wall that defines an interior room of the structure, the wall comprises an insulating layer disposed between an inner layer and an outer layer; the inner layer configured to be within the outdoor activity structure and the outer layer configured to define at least a portion of the boundary of the outdoor activity structure; wherein the inner layer is coupled with the insulating layer by a plurality of inner seams; wherein the outer layer is coupled to the insulating layer by a perimeter seam and the outer layer and insulating layer are not coupled together within the perimeter seam.

In an embodiment, the surface area of the inner layer is at least 15,000 times the thickness of the wall.

In an embodiment, an outdoor activity structure comprises a wall that defines an interior room of the structure, the wall comprises an insulating layer disposed between an inner layer and an outer layer; the inner layer configured to be within the outdoor activity structure and the outer layer configured to define at least a portion of the exterior of the outdoor activity structure; wherein the inner layer is coupled with the insulating layer by a plurality of inner seams; wherein the inner layer, the insulating layer and the inner seams define a plurality of inner cavities; wherein the outer layer is coupled to the insulating layer by a perimeter seam; wherein the outer layer, the insulating layer and the perimeter seam define an outer cavity; wherein the surface area of the outer layer and the insulating layer that define the outer cavity has an area of at least 5 times the surface area of the inner layer and the insulating layer that define an inner cavity.

In an embodiment, an outdoor activity structure comprises a wall that defines an interior room of the structure, the wall comprises an insulating layer disposed between an inner layer and an outer layer; the inner layer configured to be within the outdoor activity structure and the outer layer configured to define at least a portion of the boundary of the outdoor activity structure; wherein the inner layer is coupled with the insulating layer by a plurality of inner seams; wherein the inner layer, the insulating layer and the inner seams define a plurality of inner cavities; wherein the outer layer is coupled to the insulating layer by a perimeter seam; wherein the outer layer, the insulating layer and the perimeter seam define an outer cavity; wherein the outer cavity has a volume of at least 5 times the volume of any of the an inner cavities; wherein the outer layer is coupled to the insulating layer by a perimeter seam and the outer layer and insulating layer are not coupled together within the perimeter seam; and wherein the surface area of the inner layer is at least 15000 times the thickness of the wall.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present application is defined by the appended claims and their legal equivalents.

BRIEF DESCRIPTION OF THE FIGURES

The technology may be more completely understood in connection with the following drawings, in which.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION

The present invention is directed, in part, to an outdoor activity structure. The outer walls of the activity structure are formed of fabric, typically a multiple layer construction with at least three layers: An inner layer, an outer layer, and an intermediate insulating layer. The inner layer and intermediate layer are joined together at numerous points, typically in a quilted type construction. However, the outer layer is joined to the inner and intermediate layers much less, generally along only the perimeter of the walls of the outdoor recreational shelter. The result is an outer wall that can optionally be free-floating relative to the inner layers, thereby forming an air pocket to provide further insulation. In addition, the significant reduction in seams or stitches that go all the way through the fabric walls provides improved overall insulation, and also provides better prevention of light penetration, allowing for a darker structure (useful for spear fishing). This design also reduces "cold" spots along the wall that otherwise can occur with frequent stitching through the wall, which thus avoids condensation or frost from forming at those cold spots.

Embodiments disclosed herein include an outdoor activity structure, comprising a wall that defines an interior room of the structure, the wall comprises an insulating layer disposed between an inner layer and an outer layer; the inner layer is configured to be within the outdoor activity structure and the outer layer is configured to define at least a portion of the boundary of the outdoor activity structure; wherein the inner layer is coupled with the insulating layer by a plurality of inner seams; wherein the inner layer, the insulating layer and the inner seams define a plurality of inner cavities; wherein the outer layer is coupled to the insulating layer by a perimeter seam; wherein the outer layer, the insulating layer and the perimeter seam define an outer cavity.

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

Figure 1:
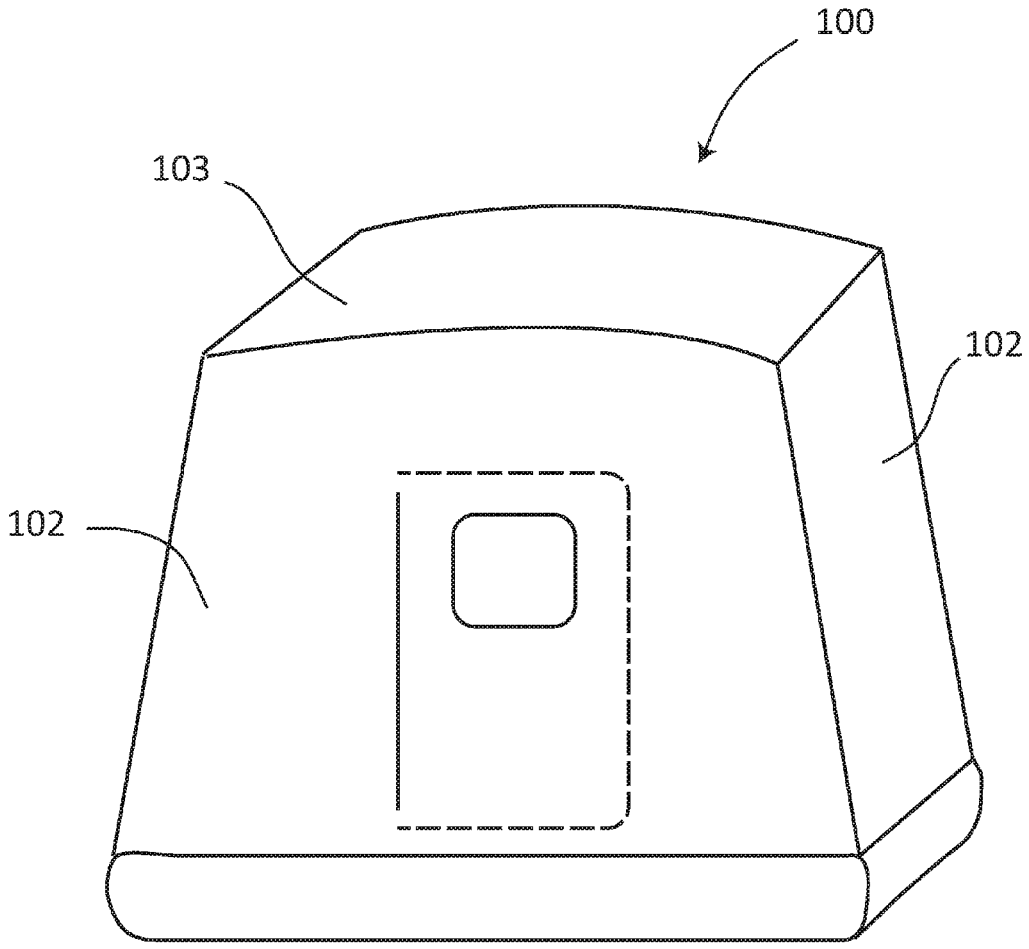
FIG. 1 is a perspective view of an outdoor activity structure, according to an embodiment.
Figure 2A:
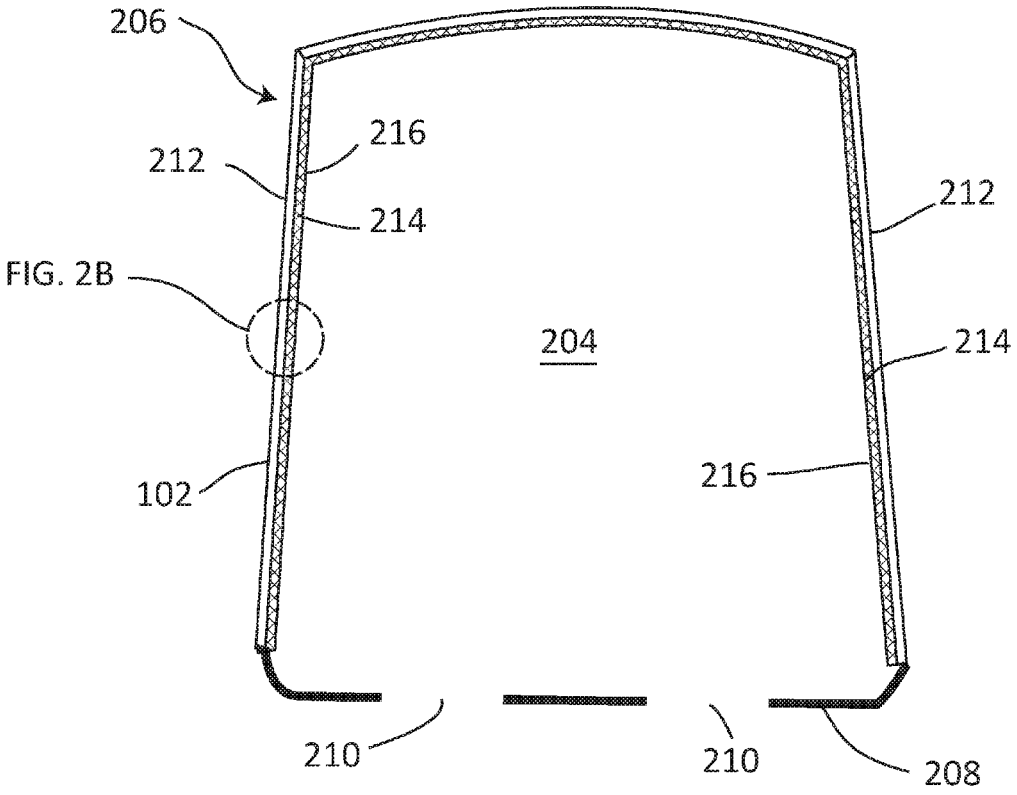
FIG. 2A is a schematic cross-section view of an outdoor activity structure, according to an embodiment, not drawn to scale.
Figure 2B:
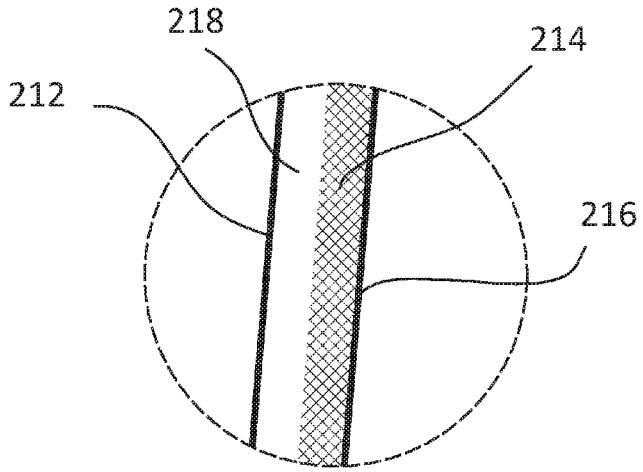
FIG. 2B is an enlarged schematic cross-section view of the wall of an outdoor activity structure of FIG. 2A.

FIG. 1 shows a perspective view of an outdoor activity structure 100, such as an ice fishing house. FIG. 2A shows a schematic (not to scale) cross-section of the outdoor activity structure shown in FIG. 1, while FIG. 2B shows an enlargement of a portion of the structure shown in FIG. 2A. The outdoor activity structure 100 defines an interior room. The interior room can be configured for people to be located within while the people ice fish or hunt (such as in a hunting blind). The interior room can also be configured to house equipment that the people use to ice fish or hunt, such as fishing tackle, fishing poles, an auger, chairs, guns, food, beverages. The technology of the present invention can allow for a particularly dark ice house, and therefore spear fishing equipment can also be present in the outdoor activity structure. In some embodiments, an outdoor activity structure 100 can be wired for electricity, such as to use an electric heater or a microwave in the outdoor activity structure 100; or can be outfitted with a propane our other heat source. Typically the outdoor activity structure 100 includes a plurality of walls 102 that extend around all sides of the outdoor activity structure 100, and also form the roof 103. Generally the outdoor activity structures 100 of the present disclosure are collapsible so that the walls fold down onto a base and can be moved about, such as being pulled behind a snowmobile or other vehicle. For this reason the outdoor activity structure 100 is often constructed of a fabric material that is supported by a frame made of metal, fiberglass, plastic, or similar material.

The inner and outer layers are typically waterproof or water resistant materials, such as nylon. The intermediate insulating layer is typically a lofted insulation, such as Thinsulate™ made by 3M Company or a similar material. The insulating intermediate layer is typically thicker than either the inner or outer layer. Having the outer layer secured to the insulating and inner layer only along the perimeter significantly reduces the number of seams all the way through the fabric (reducing by 75 percent, 80 percent, or even 90 percent relative to the length of seams joining the insulating layer and the inner layer), thereby reducing compression on the insulating layer and providing for a warmer, darker outdoor shelter.

Referring again to FIG. 1, in various embodiments, the wall 102 can be opaque, such that a person within the outdoor activity structure 100 cannot see outside of the outdoor activity structure without looking through a window, door, or other opening. In various embodiments, the wall 102 can be flexible, such that the wall 102 can be flexed, bent, folded or otherwise changed by a person, such as to collapse the outdoor activity structure 100 for easy transportation or storage.

Referring now to FIG. 2A, the wall 102 can define the interior room 204 of the structure from the exterior space of the structure 206. In various embodiments, the interior room 204 can further be defined by a floor structure 208. In an embodiment, the wall 102 can be coupled to the floor structure 208, such as around the perimeter of the floor structure 208. It will be understood that in typical embodiments the wall 102 will also extend around to form the top of the structure 106.

The floor structure 208 can be in contact with the ice when the outdoor activity structure 100 is in use on a frozen body of water. The floor structure 208 can define at least one hole 210, such as for a user to fish through. In an embodiment, the floor structure 208 can define at least two holes 210, at least three holes 210, at least four holes 210, or at least five holes 210.

The wall 102 can include a plurality of layers. In an embodiment, the wall 102 can include an outer layer 212, an insulating layer 214 and an inner layer 216. The outer layer 212 is generally the layer that is furthest away from the interior room 204. The outer layer 212 can define at least a portion of the outer boundary of the outdoor activity structure 100. The inner layer 216 can be the layer that is closest to the interior room 204 or furthest from the exterior space 206. In various embodiments, the insulating layer 214 is disposed between the outer layer 212 and the inner layer 216. FIG. 2B shows an enlargement of the schematic view shown in FIG. 2A.

Figure 3:
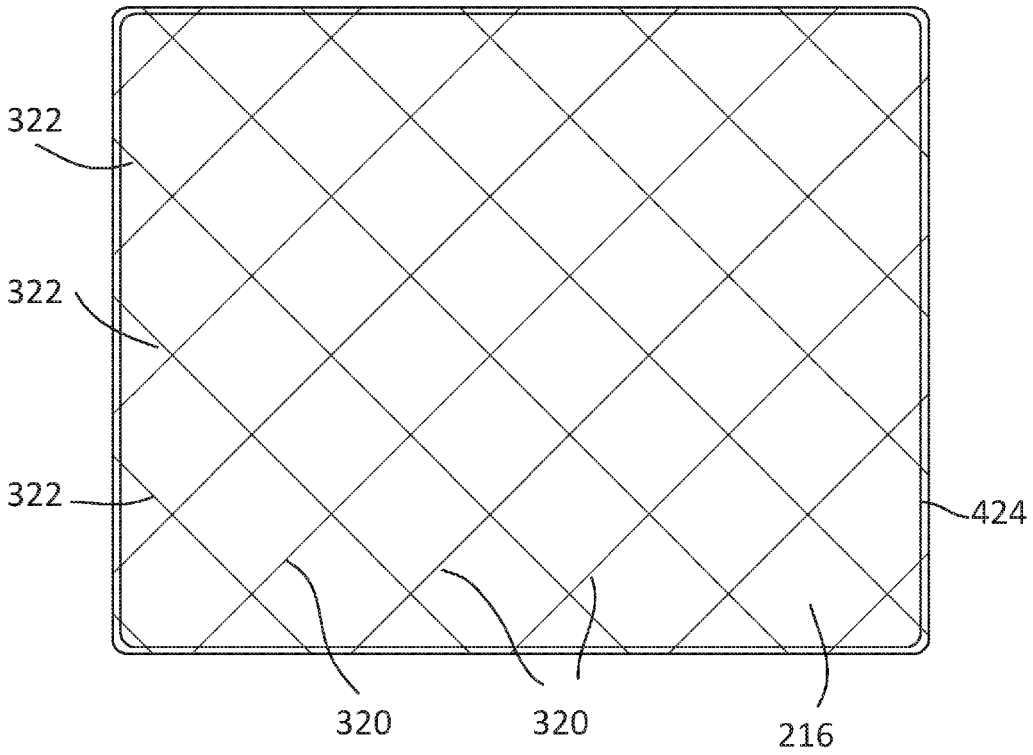
FIG. 3 is an inner view of a wall of an outdoor activity structure, according to an embodiment.

FIG. 3 shows an elevational view of a wall of an outdoor activity structure, according to an embodiment, in particular the inner layer 216. The inner layer 216 can be coupled to the insulating layer 214 with a plurality of inner seams 320 and 322. In various embodiments, the inner seams 320 and 322 couple the inner layer 216 with the insulating layer, but do not couple the inner layer 216 and insulating layer 214 with the outer layer 212, other than along a perimeter seam 424.

In an embodiment, the inner seams 318 are sonic welded seams. In an alternative embodiment, the inner seams 318 are stitched seams. In an embodiment, a stitched seam can include at least 8 stitches per inch. In an embodiment, a stitched seam can include at least 10 stitches per inch. In an embodiment, a stitched seam can include at least 14 stitches per inch. In an embodiment, a stitched seam can include at least 18 stitches per inch. In an embodiment, a stitched seam can include at least 20 stitches per inch. In an embodiment, a stitched seam can include at least 24 stitches per inch. In an embodiment, a stitched seam can include at least 28 stitches per inch.

In various embodiments, the plurality of inner seams can include a first set of inner seams 320 and a second set of inner seams 322. In an embodiment, the seams included in the first set of inner seams 320 can be parallel with the other seams included in the first set of inner seams 320. In an embodiment, the seams included in the second set of inner seams 322 can be parallel with the other seams included in the second set of inner seams 322. In an embodiment, the first set of inner seams 320 can be perpendicular to the second set of inner seams 322.

In some embodiments, the plurality of inner seams can define a plurality of quadrilaterals on the inner layer 216. In an embodiment, the quadrilaterals can be squares. In some embodiments, each edge of each quadrilateral can range from 0.5 inches to 5 inches. In some embodiments, each edge of each quadrilateral can range from 0.5 inches to 2 inches. In some embodiments, each edge of each quadrilateral can range from 1 inch to 10 inches. In some embodiments, each edge of each quadrilateral can range from 1 inch to 5 inches.

Figure 4:
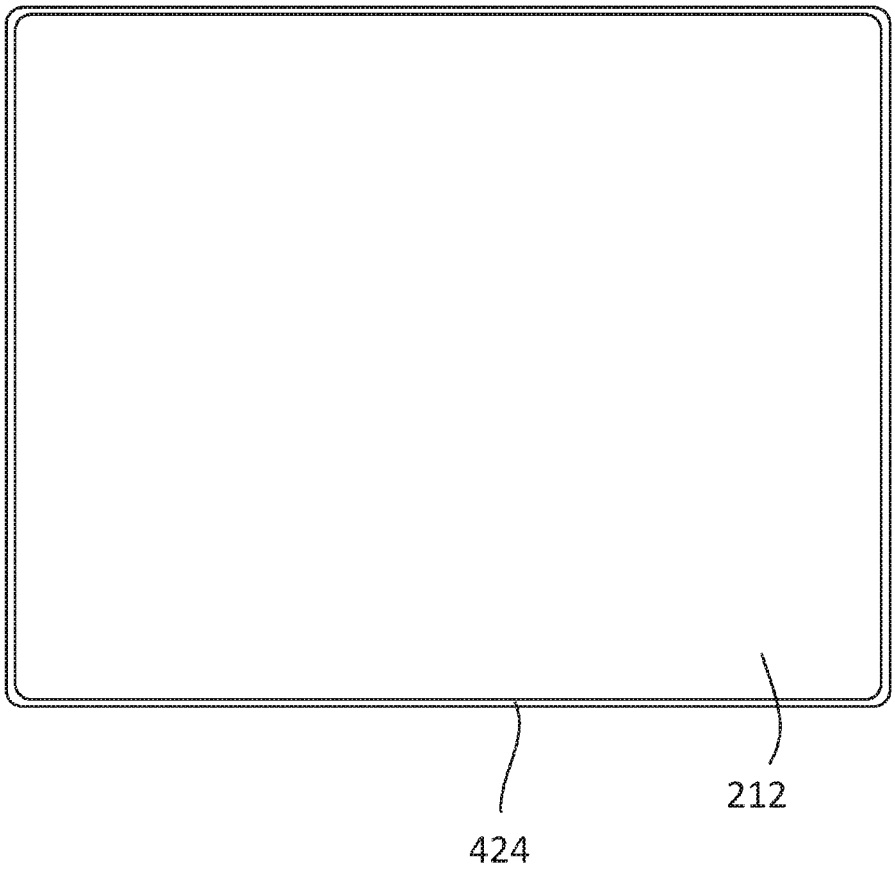
FIG. 4 is a back (outer) view of the wall shown in FIG. 3, according to an embodiment.

FIG. 4 shows a back view of the wall 102 shown in FIG. 3, according to an embodiment. FIG. 4 shows the outer layer 212 of the wall 102. In various embodiments, the outer layer 212 can be coupled to the insulating layer 214 with a seam, such as a perimeter seam 424. The perimeter seam 424 can couple the outer layer 212 with the insulating layer 214 and not the inner layer 216. In some embodiments, the perimeter seam 424 can couple the outer layer 212 with the insulating layer 214 and the inner layer 216.

The perimeter seam 424 can extend around the perimeter of the insulating layer 214 and/or the outer layer 212. The perimeter seam 424 can have the same shape as the perimeter of the insulating layer 214 and/or the outer layer 212, and not have the same size, such as when the perimeter seam 424 is located within the perimeter of the insulating layer 214 and/or outer layer 212.

In an embodiment, the perimeter seams 424 are sonic welded seams. In an embodiment, the perimeter seams 424 are stitched seams. In an embodiment, a stitched seam can include at least 8 stitches per inch. In an embodiment, a stitched seam can include at least 10 stitches per inch. In an embodiment, a stitched seam can include at least 14 stitches per inch. In an embodiment, a stitched seam can include at least 18 stitches per inch. In an embodiment, a stitched seam can include at least 20 stitches per inch. In an embodiment, a stitched seam can include at least 24 stitches per inch. In an embodiment, a stitched seam can include at least 28 stitches per inch.

Figure 5:
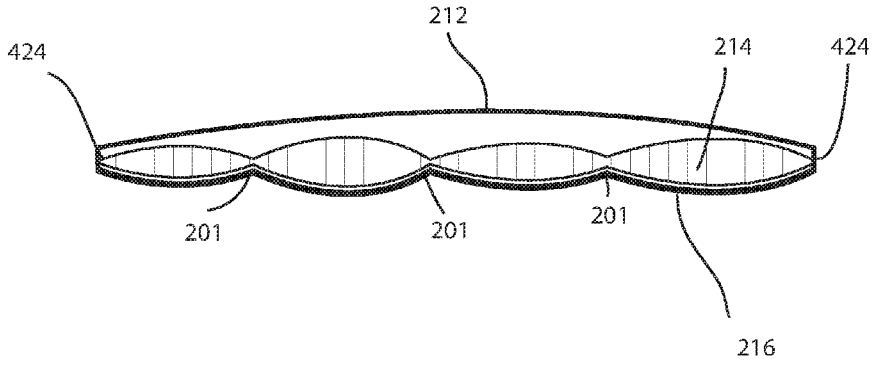
FIG. 5 is a cross-section view of a wall of an outdoor activity structure, according to an embodiment.

FIG. 5 is a cross-section view of a wall 102 of an outdoor activity structure 100, according to an embodiment. In various embodiments, the wall 102 can have a thickness of at least 0.10 inches and not more than 1.0 inches. In various embodiments, the wall 102 can have a thickness of at least 0.05 inches and not more than 0.5 inches.

In an embodiment, the thickness of the outer layer 212 can range from 0.05 inches to 0.5 inches. In an embodiment, the thickness of the insulating layer 214 can range from 0.1 inches to 0.75 inches. In an embodiment, the thickness of the inner layer 216 can range from 0.05 inches to 0.5 inches.

In some embodiments, the insulating layer 214 can have a thickness of at least half of the thickness of the wall 102, such that the thickness of the insulating layer 214 is greater than or equal to the thickness of the inner layer 216 combined with the thickness of the outer layer 212.

In various embodiments, the outer layer 212 can include nylon. In various embodiments, the outer layer 212 can be wind resistant. In various embodiments, the insulating layer 214 can include cotton. In various embodiments, the inner layer 216 can include nylon. In various embodiments, the inner layer 216 can be wind resistant.

In various embodiments, the surface area of the inner layer 216 can be 15,000 time larger than the thickness of the wall, such as if the thickness of the wall is 1 inch and the surface area of the wall 102 is 15000 square inches. Similarly, if the thickness of the wall 102 is 0.5 inches, the surface area of the inner layer can be 7500 square inches or larger.

FIG. 5 shows the perimeter seam 424 coupling the outer layer 212 with the insulating layer 214 and inner layer 216. The inner seams 201 couple the insulating layer 214 with the inner layer 216.

Figure 6:
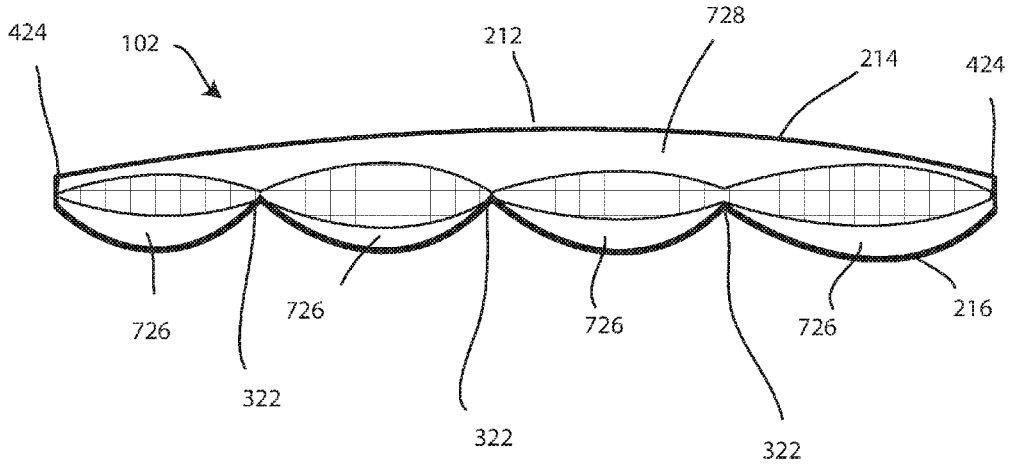
FIG. 6 is a cross-section view of a wall of an outdoor activity structure, according to an embodiment.

FIG. 6 shows a cross-section view of a wall 102 of an outdoor activity structure 100, according to an embodiment. The wall 102 can define a plurality of cavities, such as a plurality of inner cavities 726 and at least one outer cavity 728. The inner cavities 726 can be defined by the inner layer 216, the insulating layer 214, and inner seams. The outer cavities 728 can be defined by the outer layer 212, the insulating layer 214 and the perimeter seam 424.

In various embodiments, the surface area of the outer layer 212 and the insulating layer 214 that define an outer cavity 728 can be at least five times larger than the surface area of the insulating layer 214 and inner layer 216 that define an inner cavity 726. In various embodiments, the surface area of the outer layer 212 and the insulating layer 214 that define an outer cavity 728 can be at least 10 times larger than the surface area of the insulating layer 214 and inner layer 216 that define an inner cavity 726. In various embodiments, the surface area of the outer layer 212 and the insulating layer 214 that define an outer cavity 728 can be at least 20 times larger than the surface area of the insulating layer 214 and inner layer 216 that define an inner cavity 726. In various embodiments, the surface area of the outer layer 212 and the insulating layer 214 that define an outer cavity 728 can be at least 50 times larger than the surface area of the insulating layer 214 and inner layer 216 that define an inner cavity 726. In various embodiments, the surface area of the outer layer 212 and the insulating layer 214 that define an outer cavity 728 can be at least 100 times larger than the surface area of the insulating layer 214 and inner layer 216 that define an inner cavity 726. In various embodiments, the surface area of the outer layer 212 and the insulating layer 214 that define an outer cavity 728 can be at least 500 times larger than the surface area of the insulating layer 214 and inner layer 216 that define an inner cavity 726. In various embodiments, the surface area of the outer layer 212 and the insulating layer 214 that define an outer cavity 728 can be at least 1000 times larger than the surface area of the insulating layer 214 and inner layer 216 that define an inner cavity 726.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference.

The technology has been described with reference to various specific and preferred embodiments and techniques. However, it should be understood that many variations and modifications may be made while remaining within the spirit and scope of the technology.

The invention claimed is:

1. An outdoor activity structure, comprising:

a wall that defines an interior room of the structure to accommodate people, the wall comprises an insulating layer disposed between an inner layer and an outer layer;

the inner layer configured to be within the outdoor activity structure and the outer layer configured to define at least a portion of the boundary of the outdoor activity structure;

wherein the inner layer is coupled with the insulating layer by a plurality of inner seams;

wherein the inner layer, the insulating layer and the inner seams define a plurality of inner cavities;

wherein the outer layer is coupled to the insulating layer exclusively by a perimeter seam, such that the outer layer is free-floating relative to the insulating layer; wherein the outer layer, the insulating layer and the perimeter seam define an outer cavity;

wherein the outer cavity has a volume of at least 5 times the volume of any of the inner cavities.

2. The outdoor activity structure of claim 1, wherein the inner seams form a quadrilateral pattern, and each side of the quadrilateral pattern has a length of at least one inch and not more than 5 inches.

3. The outdoor activity structure of claim 1, wherein the inner layer comprises nylon.

4. The outdoor activity structure of claim 1, wherein the outer layer is wind resistant.

5. The outdoor activity structure of claim 1, wherein the perimeter seam couples the inner layer, the insulating layer, and the outer layer together.

6. The outdoor activity structure of claim 1, wherein the wall has a thickness of at least 0.05 inches and not more than 0.5 inches.

7. The outdoor activity structure of claim 1, wherein the wall is opaque.

8. The outdoor activity structure of claim 1, wherein the plurality of inner seams include a plurality of first seams and a plurality of second seams;

wherein each of the seams in the plurality of first seams are parallel with each other;

wherein each of the seams in the plurality of second seams are parallel with each other; and wherein the plurality of first seams are perpendicular to the plurality of second seams.

9. The outdoor activity structure of claim 1, wherein the wall is flexible.

10. An outdoor activity structure, comprising:

a wall that defines an interior room of the structure to accommodate people, the wall comprises an insulating layer disposed between an inner layer and an outer layer;

the inner layer configured to be within the outdoor activity structure and the outer layer configured to define at least a portion of the boundary of the outdoor activity structure;

wherein the inner layer is coupled with the insulating layer by a plurality of inner seams;

wherein the outer layer is coupled to the insulating layer by a perimeter seam and the outer layer and insulating layer are not coupled together within the perimeter seam, such that the outer layer is free-floating relative to the insulating layer.

11. The outdoor activity structure of claim 10, wherein the inner seams and the perimeter seams are sonic welded seams.

12. The outdoor activity structure of claim 10, wherein the inner seams and the perimeter seams are stitched seams.

13. The outdoor activity structure of claim 10, wherein the inner layer comprises nylon.

14. The outdoor activity structure of claim 10, wherein the outer layer is wind resistant.

15. The outdoor activity structure of claim 10, wherein the perimeter seam couples the inner layer, the insulating layer, and the outer layer together.

16. The outdoor activity structure of claim 10, wherein the wall has a thickness of at least 0.05 inches and not more than 0.5 inches.

17. The outdoor activity structure of claim 10, wherein the wall is opaque.

18. An outdoor activity structure, comprising:

a wall that defines an interior room of the structure to accommodate people, the wall comprises an insulating layer disposed between an inner layer and an outer layer;

the inner layer configured to be within the outdoor activity structure and the outer layer configured to define at least a portion of the boundary of the outdoor activity structure;

wherein the inner layer is coupled with the insulating layer by a plurality of inner seams;

wherein the inner layer, the insulating layer and the inner seams define a plurality of inner cavities;

wherein the outer layer is coupled to the insulating layer by a perimeter seam, such that the outer layer is free-floating relative to the insulating layer; wherein the outer layer, the insulating layer and the perimeter seam define an outer cavity;

wherein the outer cavity has a volume of at least 5 times the volume of any of the inner cavities;

wherein the outer layer is coupled to the insulating layer by a perimeter seam and the outer layer and insulating layer are not coupled together within the perimeter seam; and wherein the surface area of the inner layer is at least 15000 times the thickness of the wall.

* * * * *